United States Patent [19]

Fidi

[11] 4,068,093

[45] Jan. 10, 1978

[54] DEVICE FOR TRANSMITTING AUDIO-FREQUENCY SIGNALS

[75] Inventor: Werner Fidi, Baden, Austria

[73] Assignee: AKG Akustische U. Kino-Gerate Gesellschaft m.b.H., Austria

[21] Appl. No.: 727,252

[22] Filed: Sept. 27, 1976

[30] Foreign Application Priority Data

Sept. 30, 1975 Austria ..... 7472/75

[51] Int. Cl.[2] ..... H04R 5/00

[52] U.S. Cl. ..... 179/1 GP; 179/1 GQ; 179/1 J

[58] Field of Search ..... 179/1 GP, 1 GQ, 1 G, 179/1 B, 1 J, 15 BT, 100.1 TD, 100.4 ST, 1 R; 250/199; 325/59

[56] References Cited

U.S. PATENT DOCUMENTS

| | | | |
|---|---|---|---|
| Re. 25,652 | 10/1964 | Kennedy | 179/1 GP |
| 2,461,344 | 2/1949 | Olson | 179/1 SS |
| 2.837,597 | 6/1958 | Lubow | 179/1 GP |
| 3,284,633 | 11/1966 | Hathaway | 250/199 |
| 3,294,901 | 12/1966 | Stanghi | 325/392 |
| 3,614,320 | 10/1971 | Volkmann | 179/1 J |
| 3,927,262 | 12/1975 | Goeckel | 179/1 GQ |

FOREIGN PATENT DOCUMENTS

| | | | |
|---|---|---|---|
| 1,071,991 | 9/1954 | France | 179/1 SS |
| 2,143,044 | 3/1973 | Germany | 179/1 GQ |

*Primary Examiner*—Douglas W. Olms
*Attorney, Agent, or Firm*—McGlew and Tuttle

[57] ABSTRACT

The device or arrangement transforms acoustic events, in the form of single-channel audio-frequency signals, into at least two-channel audio information with the monophonic audio-frequency signals being supplied by wireless transmission to a reproducing device, with unequal delays through the two channels, and without the incorporation of a transit-time or delay element in either channel. The device comprises a transmitting device operating on the wireless principle, and including at least one infrared transmitter and at least one ultrasonic transmitter which transmitters are simultaneously modulated with the same monophonic audio-frequency signals, and includes a reproducing device operating on the wireless principle and including at least one infrared receiver and at least one ultrasonic receiver. Due to the unequal respective velocities of propagation of infrared energy and ultrasonic energy in free air, the signals transmitted as modulated ultrasonic energy are received and reproduced with a delay relative to the signals transmitted by modulated infrared energy. The reproducing device may be a stereo headset or a quadraphonic headset, and the two receivers may be mounted in respective earpieces of the headset. The reproducing device further may be a separate unit mounted on a stereo or quadraphonic headset.

9 Claims, 5 Drawing Figures

DEVICE FOR TRANSMITTING AUDIO-FREQUENCY SIGNALS

FIELD AND BACKGROUND OF THE INVENTION

The present invention relates to an arrangement for transforming acoustic events, presented in the form of single-channel audio-frequency signals, into an at least two-channel audio information, wherein the monophonic audio-frequency signals are supplied to a reproducing device with unequal delays through at least two channels.

Such an arrangement, as described, for example, in East-German Pat. No. 59,113, is intended to improve the transmission of an acoustic event which is supplied through a single channel and the reproduction of which produces mostly the impression of originating from a single point and, with headphones, of being located in the center of the head, in a manner such as to obtain a reproduction producing a three-dimensional impression or a so-called pseudostereophony, and to suppress the "in-the-head-localization" experienced with headphones, which is felt to be disturbing. In this known arrangement, two separate channels lead from the monaural source to respective sound reproducers, and one of these channels incorporates a delay device.

SUMMARY OF THE INVENTION

To obtain this effect, already a small difference in the transmit time of about 6 ms (milliseconds) is sufficient. Such a difference in the transmit time is obtained, in accordance with the invention, by providing a transmitting device operating on the wireless principle and comprising at least one infrared transmitter and one ultrasonic transmitter, both of which can be simultaneously modulated by the same monophonic audio-frequency signal, and a two-channel reproducing device comprising at least one infrared receiver and one ultrasonic receiver, so that, because of the unequal respective velocities of propagation of infrared energy and ultrasonic energy in free air, the signal transmitted by means of ultrasonic energy is received and reproduced with a delay relative to the signal transmitted by means of infrared energy, and without the use of a time delay device in either transmission channel.

A transmit time difference of the above mentioned 6 ms is obtained already with a distance of two meters between the transmitting device and the receiving device. Thus, the invention may advantageously be used for the transmission of television sound which, at present, as is well known, is effected through a single channel by means of infrared transmitters and receivers, since, in any event, it is advisable not to watch the television from a distance of less than two meters.

With a greater watching distance, of course, the signal transmitted by means of ultrasonic energy is delayed more relative to the signal transmitted by means of infrared energy. This, however, results, only in a greater areal resolution of the initially monophonic sound impression, i.e. with an increasing transmission distance, the diffusivity and, consequently, the "pseudostereo-information" becomes more pronounced.

For an understanding of the principles of the invention, reference is made to the following description of typical embodiments thereof as illustrated in the accompanying drawings.

DESCRIPTION OF THE PREFERRED EMBODIMENTS

Figure 1:
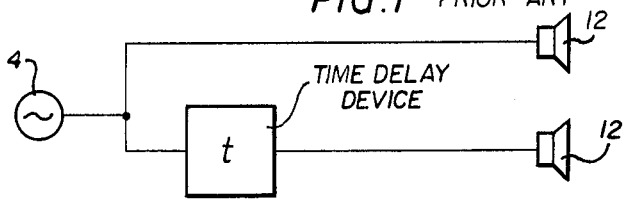
FIG. 1 PRIOR ART
FIG. 1 is a schematic block diagram of the mentioned known arrangement.

In advance of describing the preferred embodiments of the present invention, reference is made to FIG. 1 which shows a known device for supplying monophonic or monaural audio-frequency signals to reproducing devices with unequal delays and through two channels. In FIG. 1, an audio-frequency monaural or monophonic signal 4 is simultaneously supplied to two separate channels connected to respective sound reproducers, such as loudspeakers 12. A time delay device *t* is included in one channel, and both channels comprise wires leading from the monaural audo-frequency signal source 4 to the respective loudspeakers 12.

Figure 2:
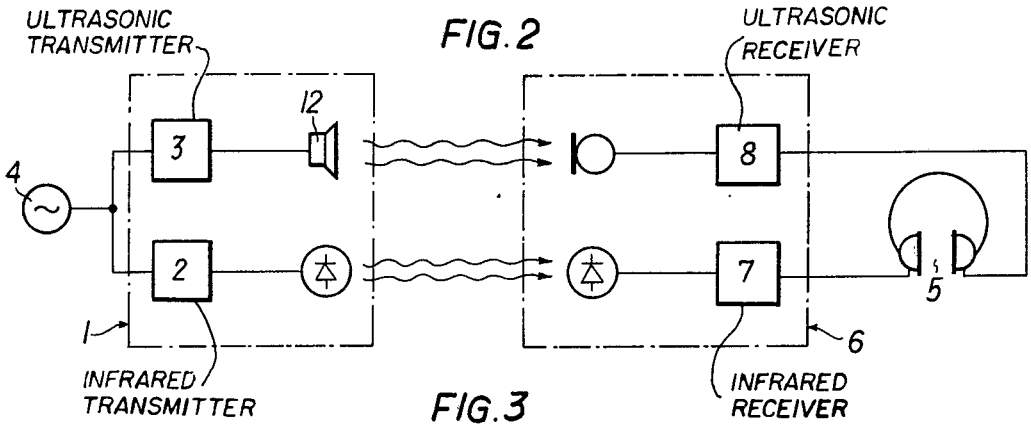
FIG. 2 is a schematic block diagram illustrating one embodiment of the present invention.

As already mentioned, the diffusivity of the sound impression is effective particularly with a headphone reproduction, such as shown in FIG. 2, illustrating one embodiment of the present invention. In FIG. 2, the source 4 of monaural or monophonic signals is connected to a transmitting device 1 operating on the wireless principle, and the monaural signals from source 4 are supplied simultaneously to an infrared transmitter 2 and an ultrasonic transmitter 3. The infrared signals and the ultrasonic signals are transmitted, by wireless, to a two-channel reproducing device 6 comprising an infrared receiver 7 and an ultrasonic receiver 8, with both receivers being connected to headphones 5.

Figure 3:
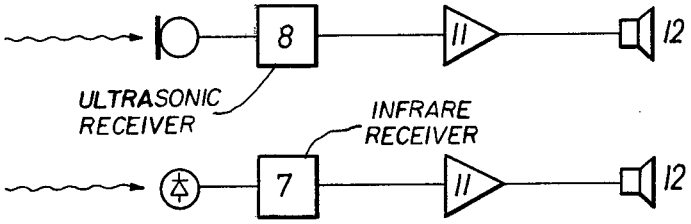
FIG. 3 is a schematic block diagram illustrating the receiver portion of the arrangement shown in FIG. 2 as including amplifiers and loudspeakers in place of the headphones.

An improvement of the sound impression, however, can be obtained in the same manner also with a loudspeaker reproduction as shown in FIG. 3. In FIG. 3, the infrared receiver 7 and the ultrasonic receiver 8 of the two-channel receiving device 6 are connected, through respective amplifiers 11, to respective loudspeakers 12. While the arrangement illustrates the power amplifiers 11, it may not be necessary to include these power amplifiers between the receivers and the loudspeakers 12.

Figure 4:
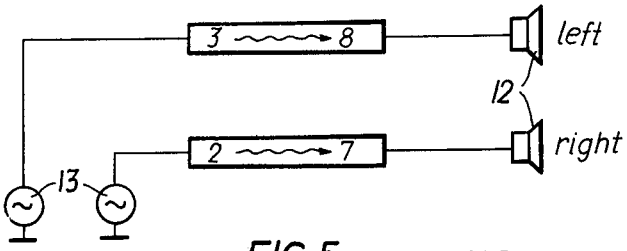
FIG. 4 is a schematic block diagram of an embodiment of the invention usable during the transmission of the stereo signal.

Additionally, an improvement of the sound impression, by delaying the signal in one channel in accordance with the invention, can also be obtained during transmission of a stereo signal from the sources 13, as illustrated in FIG. 4, and irrespective of whether the sound is reproduced through loudspeakers or through a headset. Again, the transmission is effected with a wireless technique.

Another application of the invention may be the production of signals from the pseudo-quadrophony from stereo signals, because the invention makes it possible to split each stereo channel into a delaying and a non-delaying channel, so that four channels are available.

In such a case, the signals for the front sound transmitters are transmitted by means of infrared and those for the rear sound transmitters by means of ultrasound. Both headphones and loudspeakers may be used as the sound transmitters. Such an arrangement is shown in FIG. 5.

Figure 5:
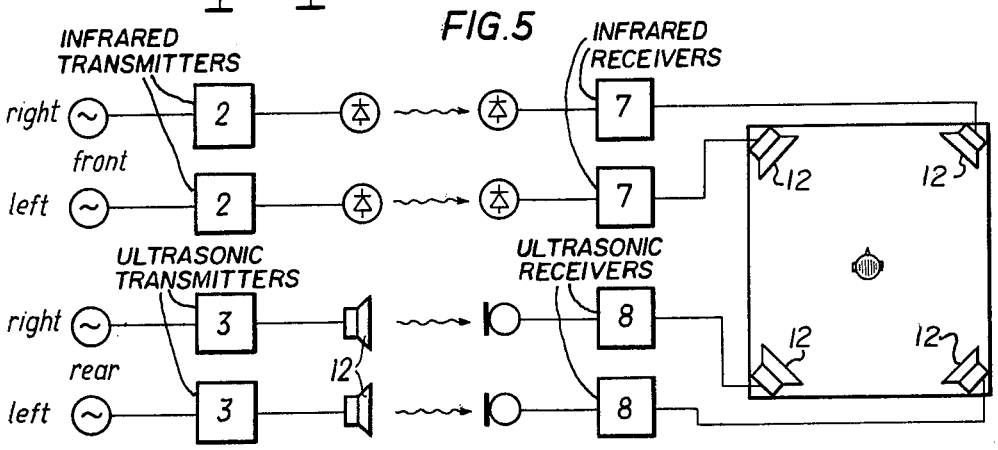
FIG. 5 is a schematic block diagram illustrating the application of the principles of the invention to quadraphonic transmission.

Referring to FIG. 5, two infrared transmitters 2 and two ultrasonic transmitters 3 have the stereo signal supplied thereto simultaneously for wireless transmission to infrared receivers 7 and ultrasonic receivers 8, which receivers are connected to respective loudspeakers 12. For such a quadraphonic transmission, either two inventive transmitting and receiving devices may be operated in parallel, or a multiplex signal may be impressed to an infrared and an ultrasonic carrier.

Finally, the receiving device can be combined with the electracoustic transducers mechanically, for example, by mounting the infrared receiver in one earpiece and the ultrasonic receiver in the other earpiece of a headset, or by designing the receiving device as a separate unit for equipping conventional sets. In both cases, for further improving the transmission, an automatic gain control as well as individually actuated balance and volume controls may be provided.

While specific embodiments of the invention have been shown and described in detail to illustrate the application of the principles of the invention, it will be understood that the invention may be embodied otherwise without departing from such principles.

What is claimed is:

1. An arrangement for transforming acoustic events, in the form of single-channel audio-frequency signals, into at least two-channel audio information, and in which arrangement the monophonic audio-frequency signals are supplied to a reproducing device, with unequal delays, through the at least two channels, said arrangement comprising, in combination, a transmitting device operating on the wireless principle and including at least one infrared transmitter, at least one ultrasonic transmitter, and means operable to simultaneously modulate the transmitters with the same monophonic audio-frequency signals; and a reproducing device operating on the wireless principle and including at least one infrared receiver and at least one ultrasonic receiver; whereby, due to the unequal respective velocities of propagation of infrared energy and ultrasonic energy in free air, the signals transmitted as modulated ultrasonic energy are received and reproduced with a delay relative to the signals transmitted by modulated infrared energy.

2. An arrangement, as claimed in claim 1, in which said reproducing device is a stereo headset with one earpiece connected to the output of said infrared receiver and its other earpiece connected to the output of said ultrasonic receiver.

3. An arrangement, as claimed in claim 2, in which said ultrasonic receiver and said infrared receiver are mounted in respective earpieces of said headset.

4. An arrangement, as claimed in claim 1, in which said reproducing device is a quadraphonic headset having front and rear electroacoustic transducers; each rear electroacoustic transducer being connected to an ultrasonic receiver and each front transducer being connected to an infrared receiver.

5. An arrangement, as claimed in claim 1, in which said reproducing device comprises a separate unit for mounting on a stereo headset.

6. An arrangement, as claimed in claim 1, in which said reproducing device comprises a separate unit for mounting on a quadraphonic headset.

7. An arrangement, as claimed in claim 1, in which said reproducing device comprises a separate unit adopted for connection to at least one stereo headset.

8. An arrangement, as claimed in claim 1, in which said reproducing device comprises a separate unit adopted for connection to at least one quadraphonic headset.

9. An arrangement, as claimed in claim 1, in which said reproducing device comprises a separate unit adopted for connection to loudspeakers through amplifiers.

* * * * *